US005742954A

United States Patent [19]

Idland

[11] Patent Number: 5,742,954

[45] Date of Patent: Apr. 28, 1998

[54] ELECTRICALLY POWERED SPA JET UNIT

[75] Inventor: Carsten H. Idland, Los Angeles, Calif.

[73] Assignee: Softub, Inc., Chatsworth, Calif.

[21] Appl. No.: 755,306

[22] Filed: Nov. 22, 1996

[51] Int. Cl.[6] ..... A61H 33/02

[52] U.S. Cl. ..... 4/541.1; 4/509; 4/541.6; 417/555.1; 417/413.1

[58] Field of Search ..... 4/541.1, 541.2, 4/541.3, 541.4, 541.5, 541.6, 492, 509; 417/415, 550, 552, 555.1, 413.1; 239/583

[56] References Cited

U.S. PATENT DOCUMENTS

| | | | |
|---|---|---|---|
| 817,314 | 4/1906 | Hahn . | |
| 1,347,082 | 7/1920 | Davis | 417/550 |
| 2,930,324 | 3/1960 | Toulmin, Jr. | 417/413.1 |
| 3,571,818 | 3/1971 | Jacuzzi . | |
| 3,886,936 | 6/1975 | Wehrenberg . | |
| 4,282,866 | 8/1981 | Miffitt | 4/541.3 |
| 4,537,565 | 8/1985 | Edler | 417/413.1 |
| 4,607,627 | 8/1986 | Leber et al. | 417/413.1 |
| 4,853,987 | 8/1989 | Jaworski | 4/509 |
| 4,867,656 | 9/1989 | Hirose | 417/550 |
| 4,907,305 | 3/1990 | Teramachi et al. | 4/541.5 |
| 4,972,531 | 11/1990 | Gravatt | 4/541.6 |
| 5,011,379 | 4/1991 | Hashimoto | 417/413.1 |
| 5,056,168 | 10/1991 | Mersmann | 4/541.6 |
| 5,386,598 | 2/1995 | Mersmann . | |
| 5,428,849 | 7/1995 | Watkins et al. . | |
| 5,454,195 | 10/1995 | Hallsten . | |
| 5,509,792 | 4/1996 | Sullivan et al. | 417/555.1 |
| 5,548,852 | 8/1996 | Rowe . | |

FOREIGN PATENT DOCUMENTS

| | | | |
|---|---|---|---|
| 132871 | 4/1933 | Austria | 4/541.3 |
| 312885 | 4/1989 | European Pat. Off. . | |
| 1227969 | 4/1960 | France . | |
| 2087513 | 12/1971 | France . | |
| 4032448 | 1/1992 | Germany . | |
| 6142156 | 5/1994 | Japan . | |

*Primary Examiner*—Charles R. Eloshway
*Attorney, Agent, or Firm*—William W. Haefliger

[57] ABSTRACT

In a spa water circulation system, the spa including wall structure facing toward a water reception zone and comprising a plurality of water pumps associated with the wall structure, the pumps spaced about the zone, and oriented to receive water intake from the zone and to discharge water streams into the zone; each pump including water pumping structure, and there being structure for controlling pumping operation of the structure.

25 Claims, 12 Drawing Sheets

ELECTRICALLY POWERED SPA JET UNIT

BACKGROUND OF THE INVENTION

This invention relates generally to improvements in hydrotherapy massage jets of the type used in spas and hot tubs, and the like. More specifically, this invention relates to a self-contained spa jet unit which is electrically powered to provide a vigorous therapeutic massage action.

Spa jet for use in spas, swimming pools, and hot tubs, and the like, are generally known in the art to provide a hydrotherapy massage action. In particular, conventional spa jets are mounted in the wall of a spa or hot tub and coupled by plumbing lines to a water recirculation system, including a pump which draws water from the pool or spa and recirculates that water to and through one or more spa jets for return flow to the pool or spa. The spa jets are designed to produce a pressure jet flow of water, which is discharged into the body of water within the pool or spa, often by means of a directionally adjustable discharge nozzle. A person within the pool or spa can orient himself in a selected position relative to a spa jet to receive a vigorous and desirably therapeutic massage action.

While conventional spa jets of the above-described type are widely used and provide a desirable hydrotherapeutic benefit, a relatively complex plumbing network is required for water recirculation to the spa jet. This plumbing network is normally installed at the time of spa construction by positioning the necessary flow conduits directly within the structural wall of the spa. This arrangement is relatively complicated and expensive, and thus contributes significantly to the overall cost of a spa system. In addition, a person using the spa typically has little or no control, other than directional adjustment over the power of the water jet discharged into the spa.

The present invention is directed to an improved spa jet unit which can be mounted quickly and easily into a spa wall without requiring construction of complex plumbing flow conduits; and further wherein the improved spa jet is adapted for relatively simple and adjustable regulation of the power and flow characteristics of a discharge water jet.

SUMMARY OF THE INVENTION

It is a major object of the invention to provide a solution to the problems and difficulties with prior water jetting systems, as used in spas and hot tubs. Basically, the invention concerns provision in a spa unit having wall means facing toward or bounding a water reception zone, of:

a) a plurality of water pumps associated with the wall means, the pumps spaced about the zone, and oriented to receive water intake from the zone and to discharge water streams into the zone, b) each pump including water pumping structure, and there being means for controlling pumping operation of such structure.

As will be seen, the water-pumping structures are independently operable and are spaced about the zone.

Another object includes provision of such pumping structures, each of which includes a chamber having a water inlet and a water outlet, and a water displacing reciprocating element operable to draw water into the chamber via the inlet and to discharge water from the chamber via the outlet. As will be seen, a local driver is typically operatively connected to the water displacing element, to reciprocate same.

Yet another object includes the provision of multiple recesses in the spa wall means, the local pumping structure received into the recesses. Those structures may be independently controlled, as to rate of reciprocation and amplitude of reciprocation. Also, the water outlets associated with the pumping structures may be defined by nozzles oriented to jet water streams into the water reception zone.

Further in accordance with the invention, a spa jet unit is provided for use in a pool or spa or the like to provide an effective hydrotherapy massage action, without requiring complex recirculation plumbing lines, for pumping water under pressure to the spa jet. Instead, the improved spa jet unit of the present invention comprises a substantially self-contained unit having an electrically powered reciprocal element to produce a pulsating discharge water jet. A control unit may be provided to regulate the reciprocal element, in a manner permitting power and frequency adjustment of the discharge water jet to suit individual preferences.

In a preferred form, the spa jet unit comprises a relatively compact housing assembly adapted for installation into a open-sided pocket formed in the wall of a spa or hot tub or the like. The housing assembly defines a pump chamber in association with intake ports through which water can be drawn from the spa into the pump chamber, and a discharge nozzle through which water can be discharged as a therapeutic jet back into the spa. The reciprocal element comprises an electrically driven solenoid having a plunger coupled to a resilient diaphragm forming one wall of the pump chamber. Reciprocal operation of the solenoid plunger is effective to draw water into the pump chamber and to discharge that water through the discharge nozzle. The stroke length and frequency of the solenoid can be regulated by a control unit to permit user adjustment of the discharge jet frequency and power.

In alternative forms, the spa jet unit can be adapted for circulating a small portion of the spa water into heat transfer relation with the electrically driven reciprocal element for cooling the reciprocal element during operation. Alternative reciprocal elements may be used, such as an electric motor having a rotary output coupled via an appropriate crank linkage to the resilient diaphragm for moving said diaphragm in a reciprocal manner. Other embodiments incorporate air induction tubing for drawing air in a regulated amount into the pump chamber, so that the discharge water jet includes entrained air for an enhanced therapeutic effect.

Other features and advantages of the present invention will become more apparent from the following detailed description, taken in conjunction with the accompanying drawings which illustrate, by way of example, the principles of the invention.

These and other objects and advantages of the invention, as well as the details of an illustrative embodiment, will be more fully understood from the following specification and drawings, in which:

DRAWING DESCRIPTION

DETAILED DESCRIPTION

Figure 12:
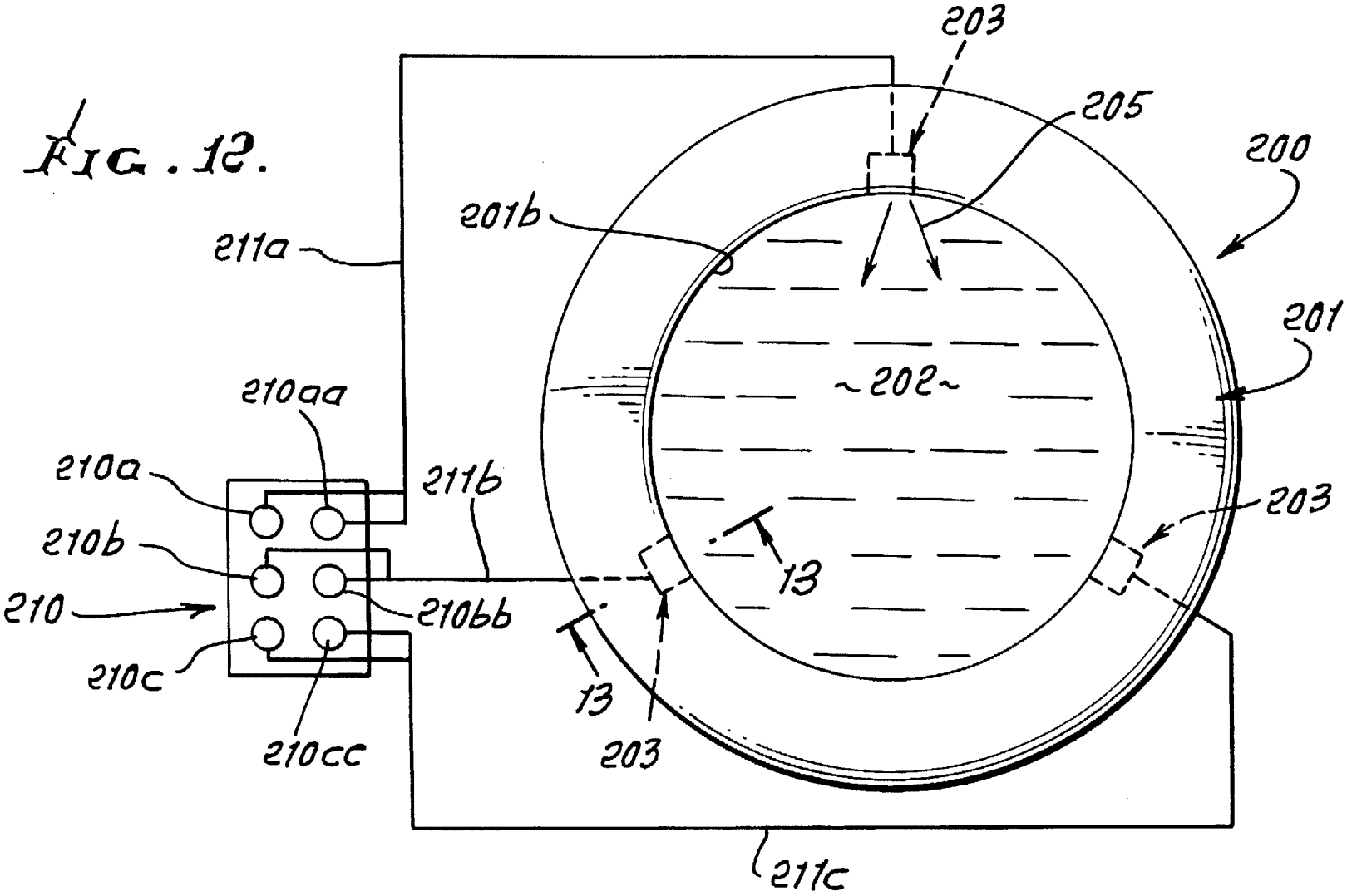
FIG. 12 is a plan view of a spa having multiple pumps.
Figure 13:
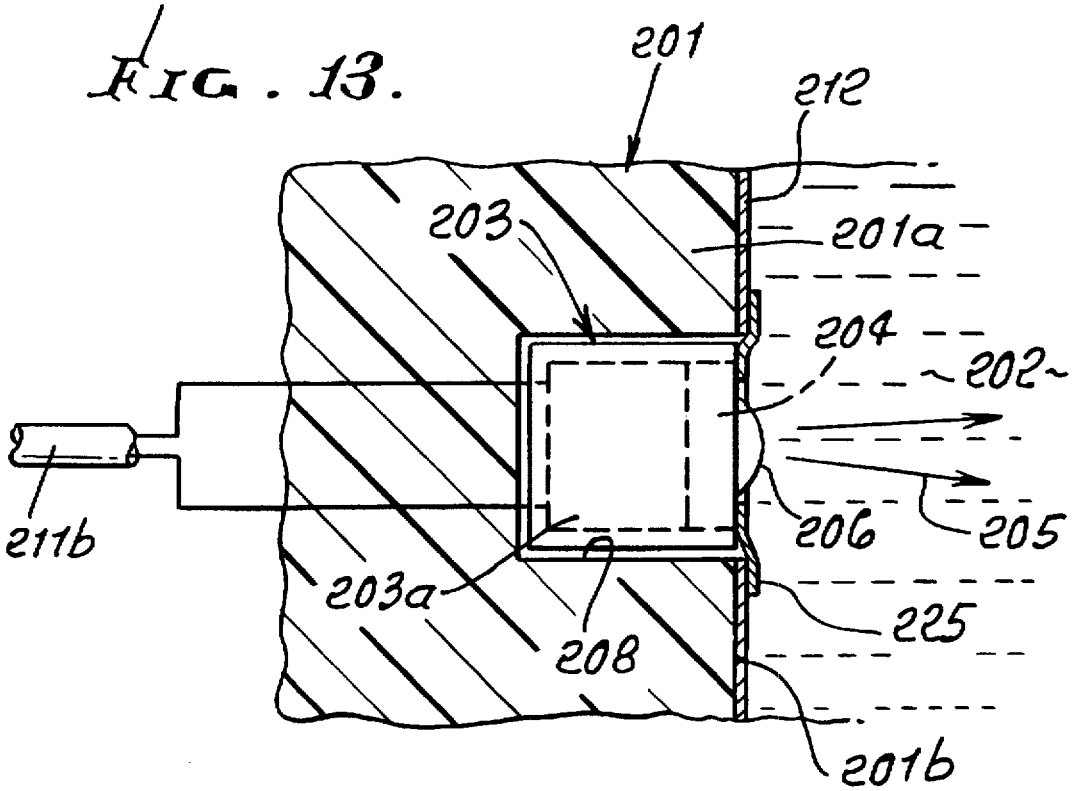
FIG. 13 is an enlarged view on lines 13—13 of FIG. 12.

Referring first to FIGS. 12 and 13, a spa 200, includes wall means, as at 201, facing toward a water reception zone 202. The wall means may include a synthetic resinous wall 201*a* bounding zone 202. The inner face of the wall means appears at 201*b*.

A plurality of water pumps are associated with the wall means, the pumps indicated generally at 203, and as spaced about zone 202. If desired, only one pump may be employed, and any number of pumps may be used. The pump or pumps are oriented to individually receive water intake from zone 202 at intake port or ports 204, and to discharge water streams 205 into zone 202, as via discharge ports. Such ports are defined by nozzle or nozzles 206.

Water pumping structure is indicated by block 207, in the pump 203 seen in FIG. 13. Note pump housing 203*a* received in the recess 208, formed in the wall 201*a*. It may be retained in position frictionally, or by other means. The water pumps are preferably independently operable, as by drive means associated with each pump and located at the pump. Also, the pumps may be operated to vary the rate of pumping action, and the stroke of the pumping element, i.e., variable as to amplitude and frequency of pumping action, to vary the jets 205 to best use of the bather. In this regard, while the pumps are herein described as operating by reciprocation, it is possible to provide rotary impeller-type pumps having controllably variable impeller rates of rotation, and so long as the jets 205 are directed toward the interior region of the spa, as indicated.

Control means to control the pumping structure is indicated generally at 210 in FIG. 12. Note the three cables 211*a*, 211*b*, and 211*c* extending respectively to the drivers at the three pumping structures 203 shown for independent control. Note the frequency and amplitude controls 210*a* and 210*aa* controlling one pump via cable 211*a*; frequency and amplitude controls 210*b* and 210*bb* controlling a second pump via cable 211*b*; and frequency and amplitude controls 210*c* and 210*cc* controlling a third pump via cable 211*c*. ON-OFF switches may be provided in or proximate of the controls 210*a*, 210*aa*, 210*b*, 210*bb*, 210*c*, and 210*cc*, for further selective control, in various combinations of amplitude and frequency of pumping action at different pumps. A spa liner may be employed, as at 212, and clamped by a pump flange 225.

As a result, a minimum of pumping structure is provided; no water liner or ducts in wall 201 are needed; the pumps are individually and independently operable and controllable.

Figure 1:
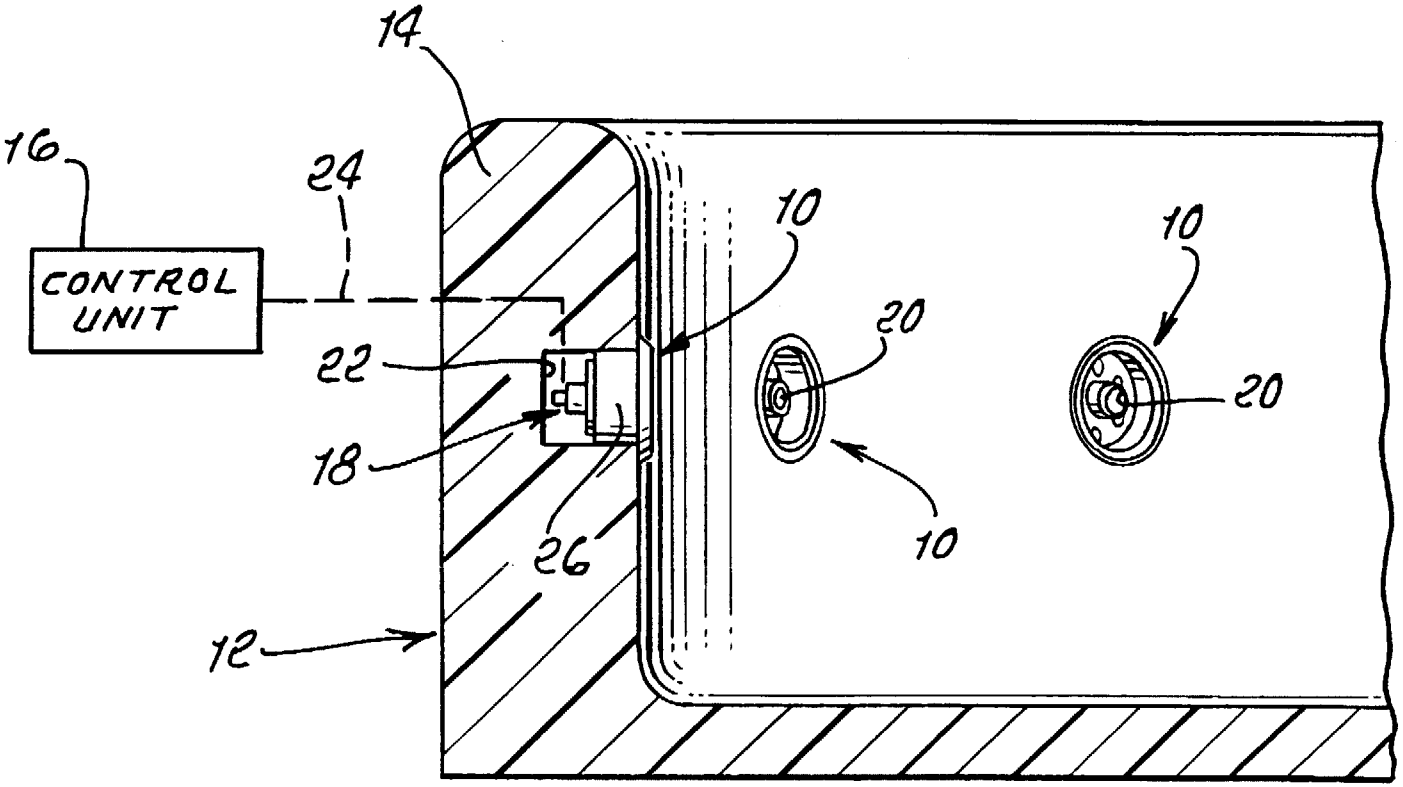
FIG. 1 is a fragmented vertical sectional view illustrating a spa, including a plurality of electrically powered spa jet units embodying the novel features of the invention.
Figure 2:
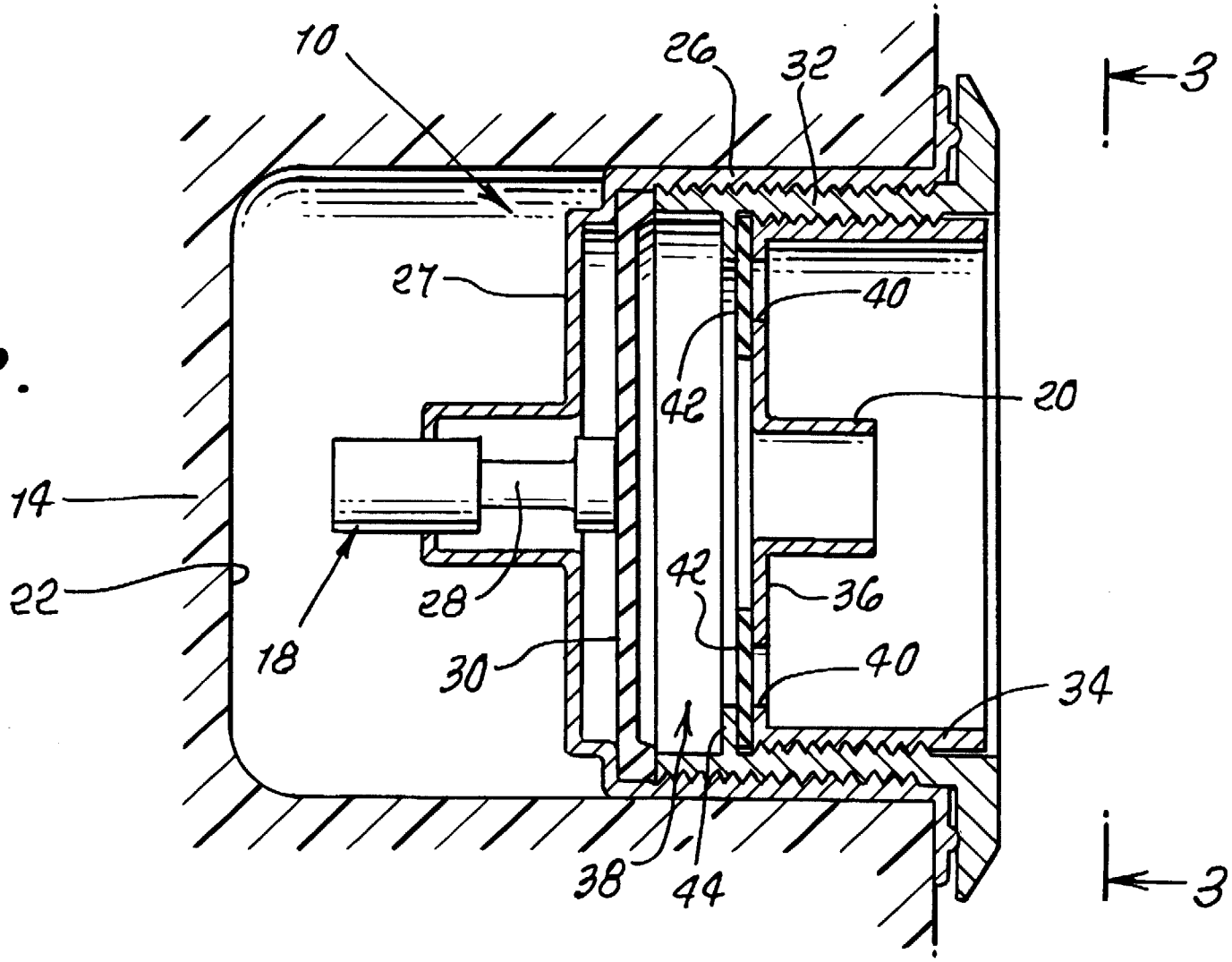
FIG. 2 is an enlarged fragmented vertical sectional view showing one of the spa jet units of FIG. 1, mounted into the spa wall.
Figure 3:
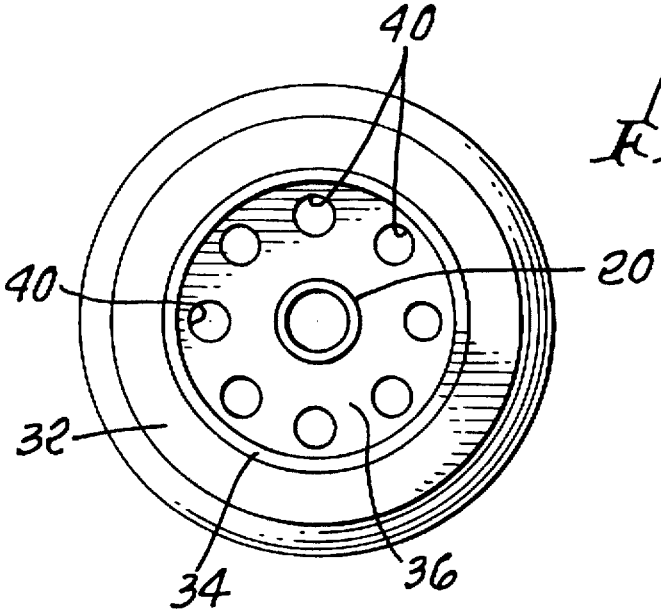
FIG. 3 is a front end elevational view of the spa jet unit, taken generally on lines 3—3 of FIG. 2.

In the exemplary drawings 1–11, an electrically powered spa jet unit, referred to generally in FIG. 1 by the reference numeral 10, is provided for use in a spa 12 or the like, to deliver a discharge jet of water to provide a hydrotherapy massage action. The spa jet unit 10 is typically installed in a side wall 14 of the spa in several selected locations about the spa perimeter and below the normal water fill line. Each jet unit 10 represents a relatively compact and substantially self-contained unit, which can be individually controlled by an appropriate control unit 16, all without requiring complex plumbing flow conduit networks and relates recirculation pump devices.

In general terms, the spa jet unit 10 of the present invention includes an electrically powered reciprocal element 18 adapted for regulation by the control unit 16 to deliver a pulsating jet of water through a discharge nozzle 20. Each jet unit 10 is adapted for mounting into an open-sided pocket 22 formed in the side wall 14 of the spa 12, with appropriate electrical conductors 24 interconnecting each jet unit 10 to the control unit 16. No plumbing conduits or related recirculating equipment are required. As a result, the overall hydrotherapy massage system is relatively simple and economical.

The spa jet unit 10 is shown in one preferred form in more detail in FIGS. 2–5. As shown, the jet unit 20 comprises a generally cup-shaped outer housing 26 adapted for slide-fit reception into the side wall pocket 22, with the reciprocal element 18 comprising a solenoid mounted on a base wall 27 of the housing 26. The solenoid 18 includes a reciprocal plunger 28 having a free end contacting and preferably connected to a central region of a resilient diaphragm 30 formed from a suitable elastomeric material. An outer rim of the diaphragm 30 is trapped or retained against the periphery of the housing base wall 27 by a retainer sleeve 32 mounted within the outer housing 26, as by means of a threaded interconnection therebetween.

A port sleeve 34 is mounted in turn within the retainer sleeve 32, as by a further threaded connection therebetween. The port sleeve 34 defines a port wall 36, which extends across the interior of the spa jet unit in a position spaced forwardly from a normal, unstressed position of the diaphragm 30. Thus, the port sleeve 34 cooperates with the diaphragm 30 to define a pump chamber 38 for the spa jet unit.

A plurality of intake ports 40 are formed in the port wall 36 in a circular pattern about the centrally positioned discharge nozzle 20, which is also formed in the port wall 36. Importantly, the rear or inboard sides of the intake ports 40 are normally covered by resilient valve flaps 42, which are retained between an inboard end of the port sleeve 34 and a short flange 44 formed on the retainer sleeve 32.

Figure 4:
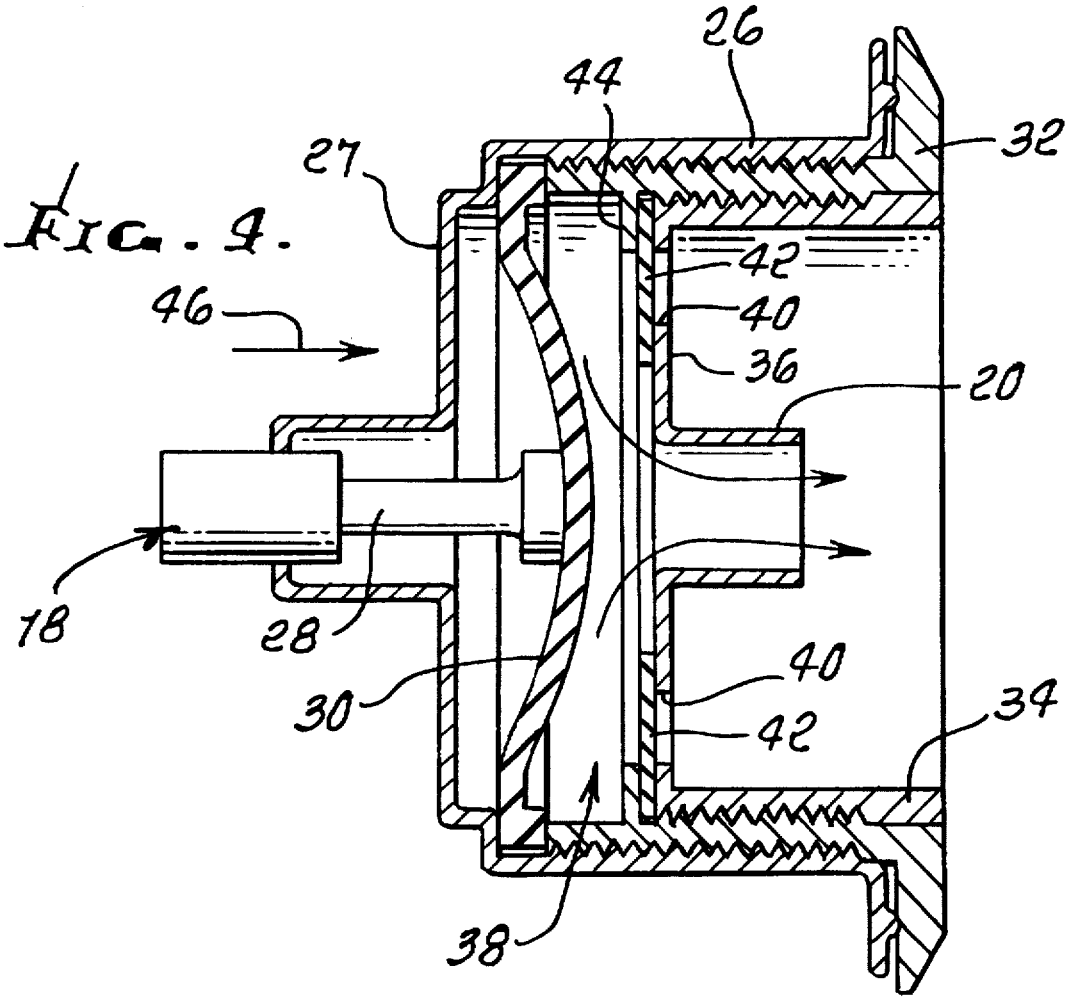
FIG. 4 is a fragmented vertical sectional view similar to FIG. 3 and illustrating operation of the spa jet unit to deliver a discharge jet of water to the spa.
Figure 5:
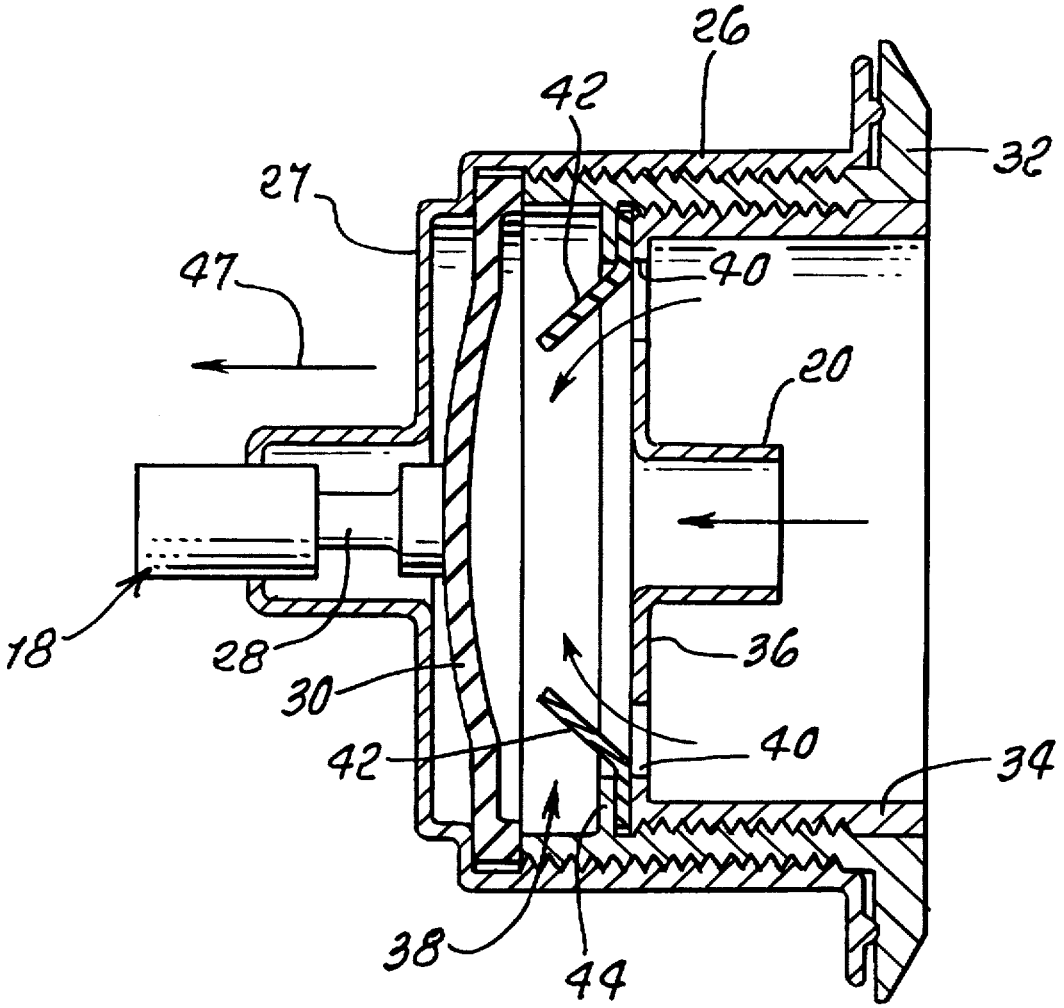
FIG. 5 is a fragmented vertical sectional view similar to FIG. 4 and depicting operation of the spa jet unit to draw water in from the spa.

As shown in FIGS. 4 and 5, reciprocal operation of the solenoid 18 is effective to draw water from the spa into the pump chamber 38 (FIG. 5), and then to discharge that water as the pressure discharge jet through the nozzle 20 (FIG. 4). More particularly, as shown in FIG. 4, movement of the solenoid plunger 28 through an advance stroke depicted by arrow 46 expels water from the pump chamber 38 in the form of a discharge jet passing outwardly through the nozzle 20. During this stroke movement, the water pressure within the chamber 38 effectively retains the valve flaps 42 in a closed position, thereby confining water discharge to passage through the nozzle 20. Subsequent movement of the plunger 28 through a retraction stroke, as depicted by arrow 47 in FIG. 5, causes the diaphragm 30 to flex rearwardly, resulting in a momentary vacuum within the chamber 38, whereby water is drawn from the spa into the pump chamber 38 through the intake ports 40, as well as via the nozzle 20. FIG. 5 shows pressure-caused retraction of the valve flaps 42 to accommodate relatively free inflow of water through intake ports 40 into the pump chamber 38.

The control unit 16 (FIG. 1) includes appropriate controller components for regulating the operation of the solenoid 18 in a manner achieving adjustable discharge jet power and pulse rate. For example, a pulse width modulator with frequency control may be used for regulating the reciprocating frequency and/or stroke length of the solenoid 18, according to the preferences of an individual using the spa. Alternately, pulse width modulation systems may be employed to achieve a range of power and frequency selection, which can be programmed through variable speed frequencies. The control unit 16 may be used for common control of multiple spa jet units 10, or otherwise adapted to individually control each spa jet unit.

Figure 6:
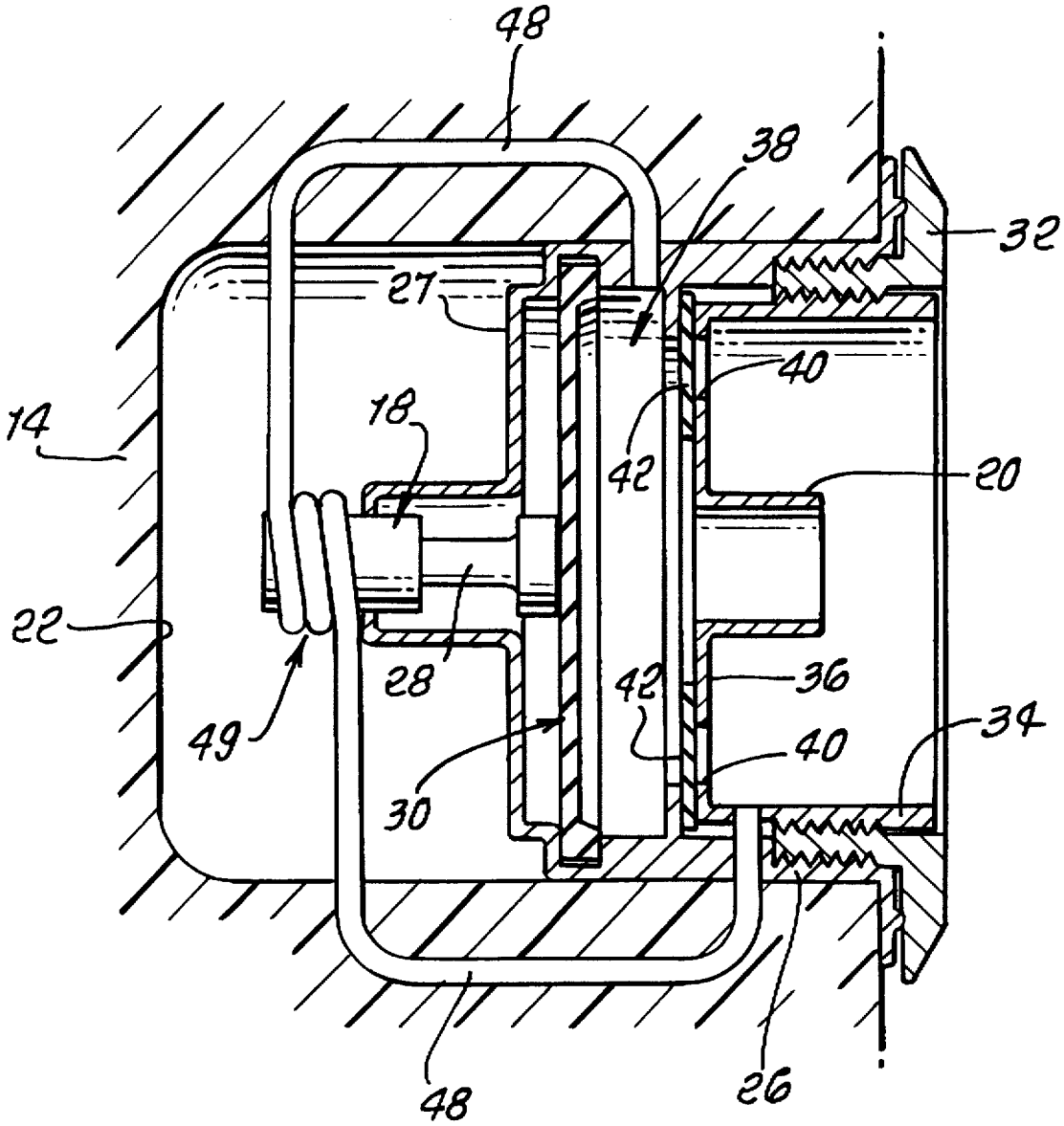
FIG. 6 is a fragmented vertical sectional view similar to FIG. 2, and illustrating an alternative form of the invention, which uses the spa water for solenoid cooling.

FIG. 6 illustrates one alternative form of the invention wherein components identical to those shown and described in FIGS. 1–5 are referred to by common reference numerals. FIG. 6 differs from the embodiment of FIGS. 1–5 in that a small flow of water is employed to cool the solenoid 18, thereby preventing overheating thereof during operation. As shown, this small water flow is obtained by providing a small circulation tube 48 with an inlet end tapped into the pump chamber 38. The circulation tubing 48 includes a coil segment 49 wrapped about the winding portion of the solenoid 18 in heat transfer relation therewith, and then extends to a discharge end connected to the region in front of the port wall 36. During reciprocal solenoid operation, a small portion of the water under pressure within the pump chamber 38 is forced to flow through the circulation conduit 48 to cool the solenoid.

Figure 7:
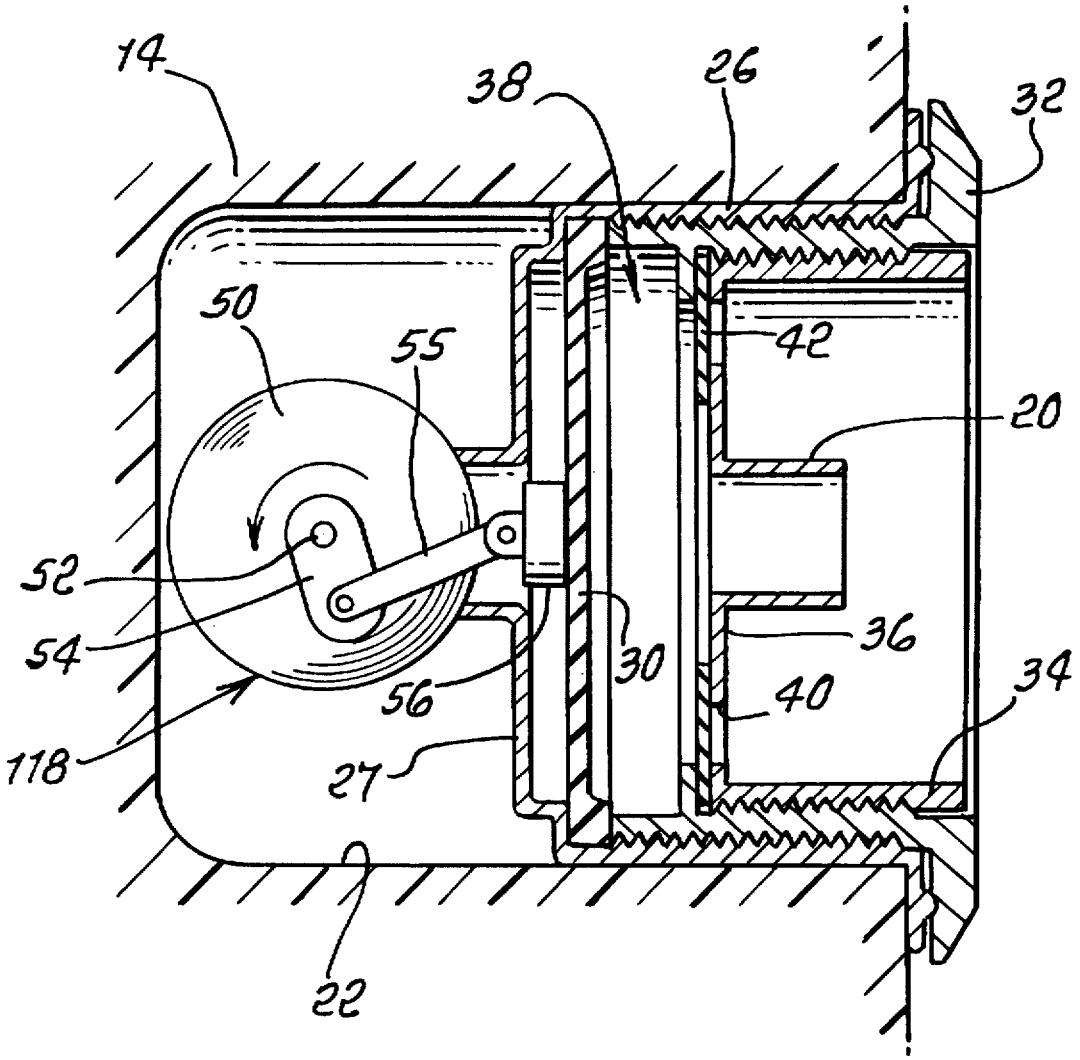
FIG. 7 is a fragmented vertical sectional view similar to FIG. 2 but illustrating an alternative electrically-driven reciprocal element.

FIG. 7 shows another alternative form of the invention wherein a modified reciprocal element 118 is provided in lieu of the solenoid device shown in FIGS. 1–6. In this version, an electric motor 50 is mounted on the base wall 27 of the outer housing 26, and includes a rotary output shaft 52 connected by a pair of crank links 54 and 55 to a head 56 coupled to the diaphragm 30, in the same manner as previously described with respect to the solenoid plunger 28. Operation of the motor 50 displaces the crank links 55 and 55 in a manner providing the desirable reciprocal action of the diaphragm 30, as previously described.

Figure 8:
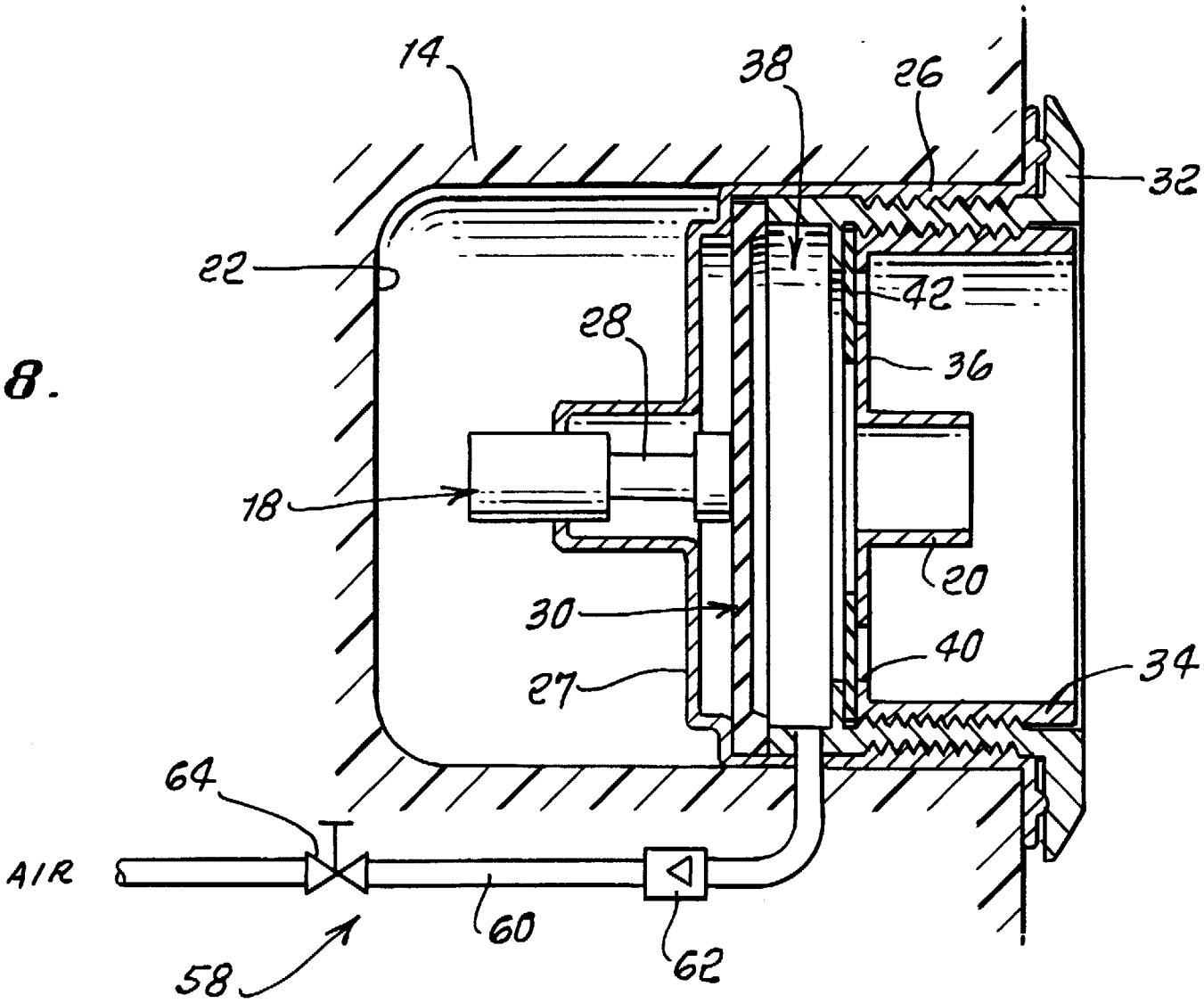
FIG. 8 is a fragmented vertical sectional view similar to FIG. 2 and illustrating air induction tubing for use in combination with the spa jet unit.

FIG. 8 shows a further alternative form of the invention, generally in accordance with FIGS. 1–5, except for the inclusion of an air induction system 58. The structural components shown in FIG. 8 are otherwise identical to those shown and described in FIGS. 1–5, and are thus identified by common reference numerals. The air induction system 58 comprises an air induction tube 60 having one end coupled to ambient air, and an opposite end tapped into the pump chamber 38. A one way check valve 62 is mounted along the air tube 60 to permit air inflow to the pump chamber 38, while preventing water backflow through the air tube. A control valve 64 may be provided to regulate air flow through the air tube 60.

During operation, and upon retraction motion of the diaphragm 30 to draw water into the pump chamber 38, the momentary vacuum in the pump chamber 38 additionally draws air therein via the air tube 60. As a result, a quantity of air is entrained with the water within the pump chamber 38, for discharge with the water as an air-water jet during subsequent advance stroke motion of the diaphragm 30. The combined air-water jet is known to provide an enhanced therapeutic massage action.

Figure 9:
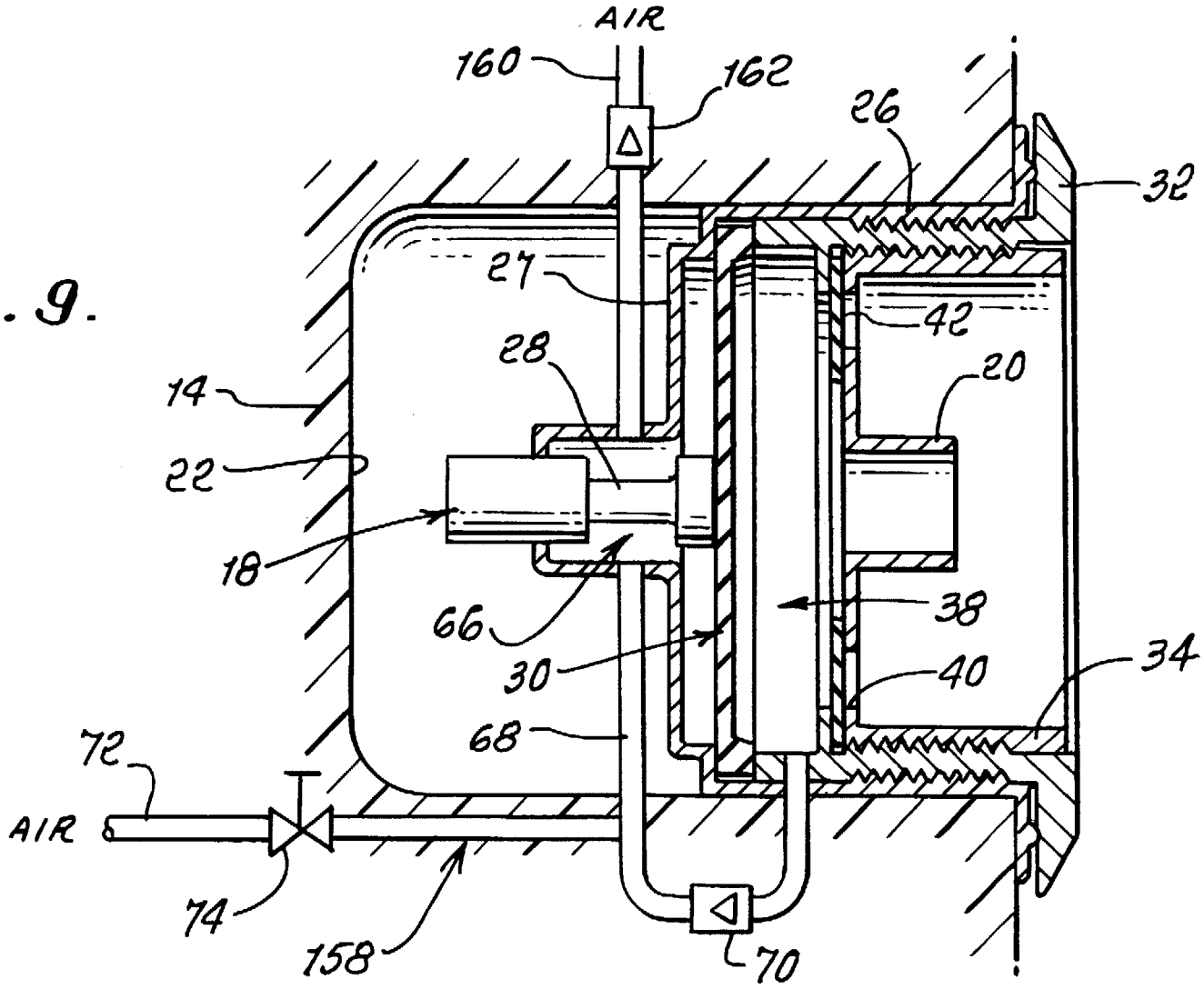
FIG. 9 is a fragmented vertical sectional view similar to FIG. 8, but illustrating an alternative air induction system for use with the spa jet unit.

FIG. 9 illustrates an alternative air induction system 158 wherein the back or inboard side of the diaphragm 30 cooperates with the housing base wall 27 to define an air chamber 66 for pumping air into the spa jet unit. In this version, an air tube 160 with a check valve 162 therein is provided for drawing air into the air chamber 66 each time the diaphragm 30 is displaced forwardly by the solenoid 18. Subsequent retraction of the diaphragm 30 is effective to expel air from the chamber 66 through a tube segment 68 and associated check valve 70 for passage into the pump chamber 38 and entrainment with water therein. A bleed tube 72 may be connected into the tube segment 68, and equipped with an adjustable valve 74 for regulating the amount of air injected into the pump chamber 38. Air injected into the pump chamber is, of course, expelled with the water as a combined air-water jet through the forward nozzle 20.

Figure 10:
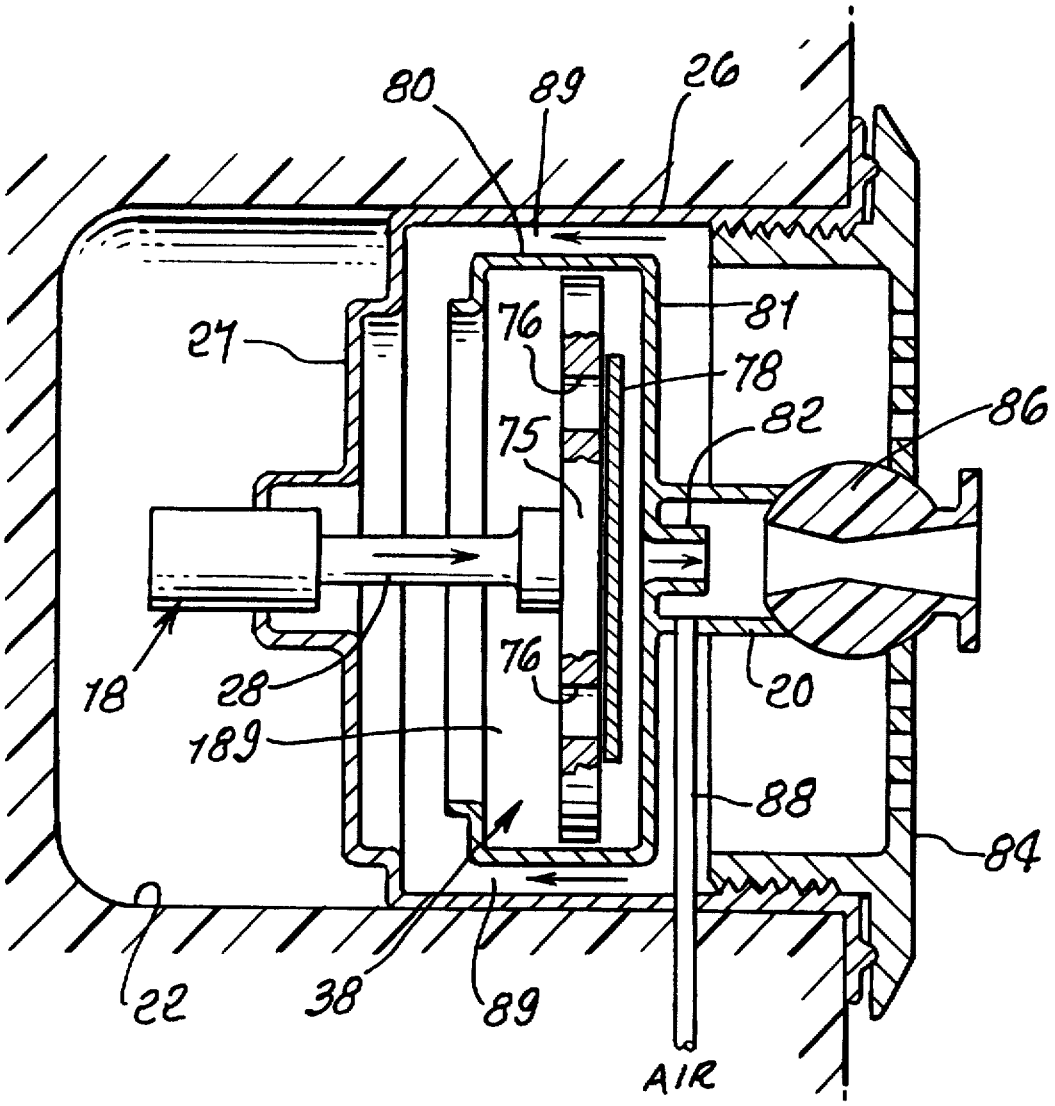
FIG. 10 is a fragmented vertical sectional view similar to FIG. 2, but depicting a further alternative form of the invention.
Figure 11:
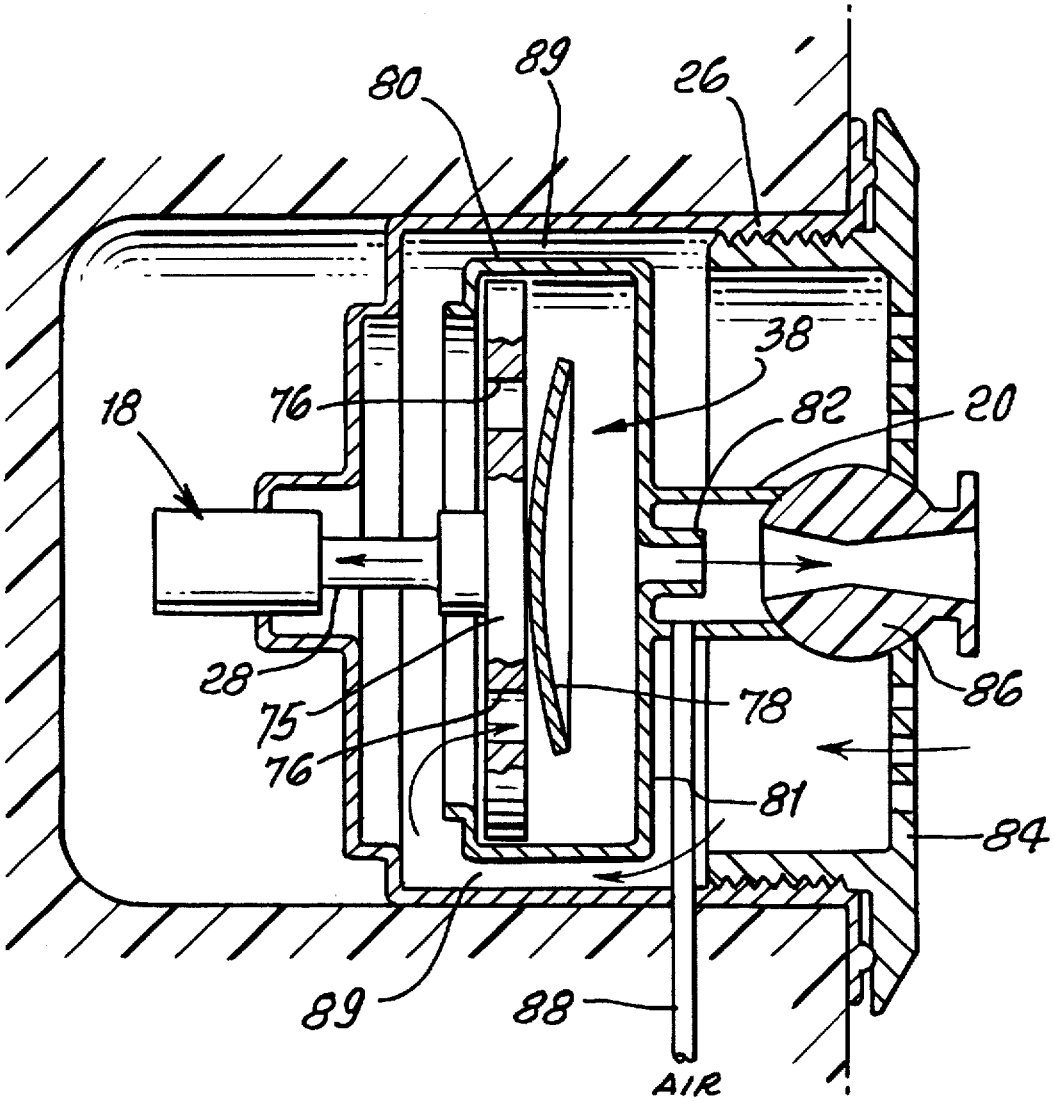
FIG. 11 is a fragmented vertical sectional view similar to FIG. 10, and showing the spa jet unit moved through a retraction stroke.

FIGS. 10 and 11 show still another alternative embodiment of the invention wherein components corresponding in structure and function to those shown and described in FIGS. 1–5 are identified by common reference numerals. In this embodiment, a cup-shaped outer housing 26 has a solenoid 18 carried by a base wall 27 thereof, with a reciprocal plunger 28 coupled to a pumping piston 75. The piston 75 comprises a circular plate having an annular array of pump ports 76 formed therein, with the outboard side of the ports 76 being normally covered by a resilient flap valve 78, the center of which is secured in a suitable manner to the pump piston 75. The piston 75 is reciprocally carried within a cylinder 80 and cooperates with a front wall 81 of the cylinder 80 to define the pump chamber 38. The pump chamber is open to the body of water within the spa through a forward discharge nozzle 20, which may include a narrow central jet port 82.

As shown, the outboard side of the spa jet unit includes a perforated cover plate 84, which cooperates with the nozzle 20 to retain an angularly adjustable nozzle fitting 86. An air induction tube 88 is coupled to the interior of the nozzle 20, at the downstream side of the jet 82, to permit entrainment of air therein in response to water pumping through the nozzle 20.

Advancement of the solenoid plunger 28 displaces the pump piston 75 in a forward direction within the pump chamber 38, to displace water therein as a discharge jet outwardly through the nozzle 20 and associated nozzle fitting 86. During this discharge step, the flap valve 78 sealingly overlies the piston ports 76, so that the water in the pump chamber 38 is forced outwardly into the spa (FIG. 10). While a peripheral seal may be provided between the pump piston 75 and the inner diameter of the cylinder 80, a small clearance between these elements will normally suffice to provide the desired pumping function.

Subsequent retraction of the solenoid plunger 28 draws the piston 75 rearwardly within the cylinder 80. In this regard, the inboard side of the pump piston 75 and the cylinder 80 is in open flow communication with the perforated coverplate 84, around the periphery of the cylinder 80, so that water behind the piston 75 is allowed to displace forwardly through the pump ports 76 into the pump chamber 38. The flap valve 78 flexes forwardly (FIG. 11) as the piston is drawn rearwardly by the plunger 28, to allow the water to flow through the pump piston 75. Accordingly, reciprocal driving of the piston 75 within the cylinder 80 affectively discharges a water jet through the nozzle 20 and nozzle fitting 86, in a pulsating fashion, to provide a desirable therapeutic massage action.

FIG. 10 also shows the pump unit in discharge motion, the flow channels 89 having water flowing in an inwardly direction, as marked by the arrows and toward chamber 189 rearwardly of the reciprocating elements 75 and 78. This flow is in opposite direction to the flow through the central jet port 82, as marked by the arrow. And is a result of a negative pressure created rearwardly of element 75 as the element moves forwardly in the discharge motion. With proper design, these flows are balanced to cancel or reduce momentum forces transmitted to the spa or tub wall.

Referring to FIG. 11, it shows the pump unit in retraction motion. Flap seal 78 opens to allow free fluid movement through the reciprocating element. No substantial fluid movement is produced through central jet port 82 or through flow channels 89.

Figure 14:
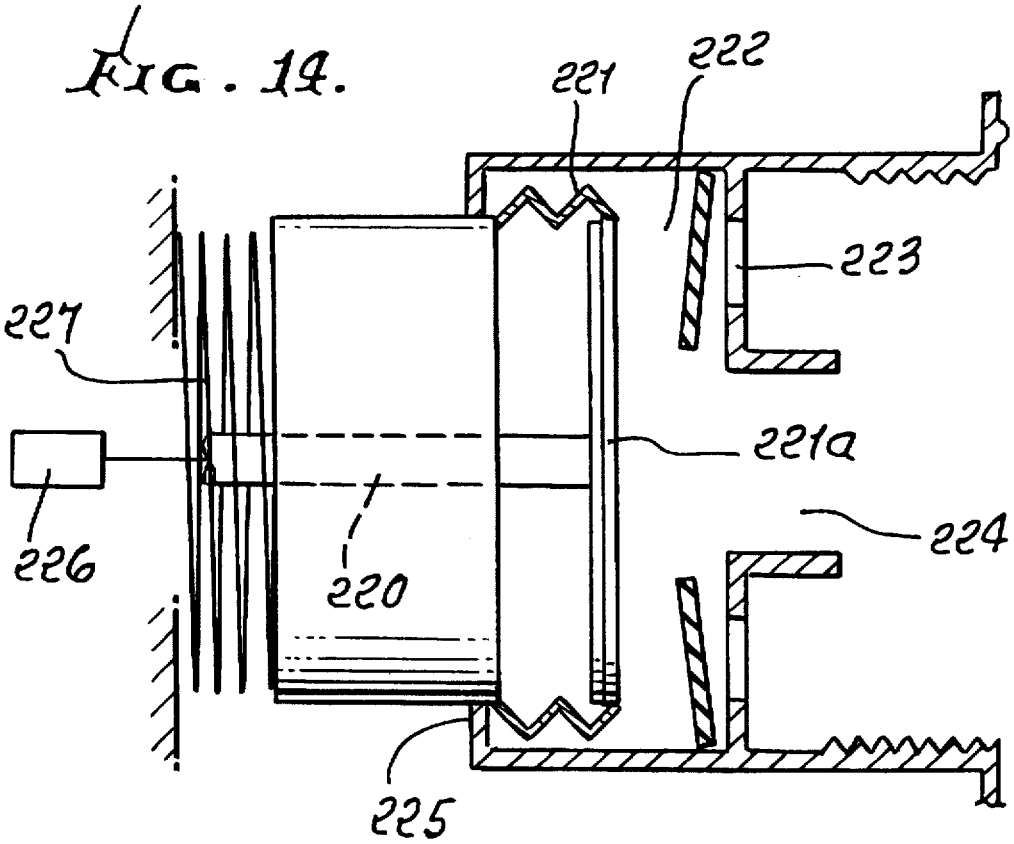
FIG. 14 shows a modification using a bellows.

FIG. 14 shows an embodiment wherein the reciprocating element 200 drives end wall 201*a* of a bellows 201 in reciprocation, to draw fluid into chamber 202 via ports 203 and passage 204, and to discharge fluid through passage 204. The bellows also provides a seal connection to chamber wall 205, to seal off and protect the solenoid 206 from the water. A return spring is used at 207.

In devices as described, the housing may consist of a material which readily transmits heat causing a thermal connection between the solenoid and water in order to cool the solenoid.

A variety of further modifications and improvements to the spa jet unit of the present invention will be apparent to persons skilled in the art. Accordingly, no limitation on the invention is intended by way of the foregoing description and accompanying drawings, except as set forth in the appended claims.

I claim:

1. For use in a water circulation device for a spa having wall means facing toward a water reception zone, the combination comprising a) housing means adapted for carriage by said wall means, b) pumping structure associated with said housing means, c) and control means for controlling pumping operation of said pumping structure, d) there being inlet and outlet porting provided to create a simultaneous intake and discharge of fluid, so as to balance and cancel or reduce an associated momentum change, which in turn reduces forces imposed on said wall means, e) there being an inner chamber within which a movable part of the pumping structure is reciprocable, and from which water is discharged relatively forwardly to said outlet porting, said part having forward and rearward sides, f) and there being an outer passage extending outwardly of and about said inner chamber, and to which water is drawn via said inlet porting, said outer passage communicating with a rear side of said inner chamber to deliver water to the rearward side of said part, said inlet and outlet porting, said inner chamber, and said outer passage being within said housing means.

2. The combination of claim 1 wherein said pumping structure includes a driver for reciprocating said part.

3. The combination of claim 2 wherein said control means is operatively connected to said driver for controlling at least one of the following:

i) the rate of reciprocation of said part ii) the amplitude of movement of said part.

4.The combination of claim 2 wherein said driver comprises one of the following:

i) a solenoid coupled to said part ii) an electric motor having rotary structure coupled to said part.

5.The combination of claim 1 wherein said outlet porting includes a nozzle sized to jet a stream of water into said water-reception zone.

6. The combination of claim 5 including air induction means in communication with water being pumped, for entrainment in said jet stream.

7. The combination of claim 6 wherein said air induction means includes an air duct extending to a housing chamber forwardly of said inner chamber.

8. The combination of claim 7 including check valve means in series with said air duct to pass air in one direction toward said chamber, and to block water backflow through the duct.

9. The combination of claim 7 including adjustable means associated with said duct to regulate the quantity of air passing to said chamber.

10. The combination of claim 5 wherein said nozzle includes a movable component for controllably adjusting the direction of flow of water through the nozzle to the water reception zone.

11. In a spa water circulation system, the spa including wall means facing toward a water reception zone, the combination comprising a) plurality of water pumps associated with said wall means, said pumps spaced about said zone, and oriented to receive water intake from said zone and to discharge water streams into said zone, b) each pump including water pumping structure, and there being means for controlling pumping operation of said structure, c) and wherein inlet and outlet porting is provided to create a simultaneous intake and discharge of fluid, so as to balance and cancel or reduce an associated momentum change, which in turn reduces forces imposed on said wall means, d) each said pump including i) an inner chamber within which a movable part of the pumping structure is reciprocable, and from which water is discharged relatively forwardly to said outlet porting, said part having forward and rearward sides, and said inner chamber having a rearward portion, said inlet and outlet porting located forwardly of said reciprocable part, ii) an outer passage extending outwardly of and about said inner chamber, and to which water is drawn via said inlet porting, said outer passage communicating with the rearward portion of said inner chamber to deliver water to the rearward side of said part.

12. The combination of claim 10 wherein said water pumping structures are independently operable, and are spaced about said zone.

13. The combination of claim 12 wherein said water pumping structures are carried by said wall means.

14. The combination of claim 13 wherein said wall means defines recesses opening toward said water reception zone, and said pumping structures are adapted to be received into said recesses.

15. The combination of claim 14 wherein said pumping structures include housings containing said pumping structures, said housings adapted to be removably received and retained in said recesses.

16. The combination of claim 15 wherein said housings have flanges to clamp against flexible liner means associated with said wall means.

17. The combination of claim 11 wherein each said pumping structure includes a driver operatively connected with said part to reciprocate same.

18. The combination of claim 11 wherein said outlet porting includes a water outlet defined by a nozzle sized to jet water into said water reception zone.

19.The combination of claim 11 including a housing about said outer passage and said inner chamber.

20. The combination of claim 19 wherein the housing includes a front wall defining said porting forwardly of said inner chamber.

21. The combination of claim 11 including a solenoid driver operatively connected with said part.

22. The combination of claim 21 including an electronic control means which powers said solenoid, so as to provide capability to change both the pulse width and the frequency of power to the solenoid which results in control of the force and pulse rate of the water discharged.

23. The combination of claim 11 wherein said inlet porting includes multiple ports to pass water via said ports in response to reciprocation of said movable part.

24. The combination of claim 11 wherein said movable part defines multiple through openings to pass water.

25. The combination of claim 24 including flap valve means flexingly cooperating with said openings to promote water flow forwardly via said openings in response to reciprocation of said movable part.

* * * * *